US006276436B1

(12) United States Patent
Pleschiutschnigg

(10) Patent No.: US 6,276,436 B1
(45) Date of Patent: Aug. 21, 2001

(54) METHOD AND APPARATUS FOR HIGH-SPEED CONTINUOUS CASTING PLANTS WITH A STRAND THICKNESS REDUCTION DURING SOLIDIFICATION

(75) Inventor: Fritz-Peter Pleschiutschnigg, Duisburg (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/004,430

(22) Filed: Jan. 8, 1998

(51) Int. Cl.[7] ..... B22D 11/12
(52) U.S. Cl. ..... 164/476; 164/452
(58) Field of Search ..... 164/476, 417, 164/424, 452

(56) References Cited

U.S. PATENT DOCUMENTS 5,803,155 * 9/1998 Larazza et al. ..... 164/476
5,853,043 * 12/1998 Takenchi et al. ..... 164/476

FOREIGN PATENT DOCUMENTS 4139242 6/1993 (DE) .

* cited by examiner

*Primary Examiner*—Nam Nguyen
*Assistant Examiner*—I. H. Lin
(74) *Attorney, Agent, or Firm*—Friedrich Kueffner

(57) ABSTRACT

A method and an apparatus for continuous casting plants for producing strands whose cross-section is reduced during solidification. The continuous casting method for producing strands, wherein the cross-section of the strands is reduced during the solidification, includes casting into a mold, particularly an oscillating mold, and reducing the strand cross-section linearly over a minimum length of the strand guiding unit immediately underneath the mold, i.e., casting and rolling, and subsequently carrying out a further strand cross-section reduction through the remaining strand guiding unit, i.e., soft reduction, up to maximum reduction immediately in front of the final solidification or sump tip.

10 Claims, 7 Drawing Sheets

SCHEMATIC ILLUSTRATION OF SEGMENTS 1-n

METHOD AND APPARATUS FOR HIGH-SPEED CONTINUOUS CASTING PLANTS WITH A STRAND THICKNESS REDUCTION DURING SOLIDIFICATION

BACKGROUND OF THE INVENTION

1. Field of the Invention

The present invention relates to a method and an apparatus for continuous casting plants for producing strands whose cross-section is reduced during solidification.

2. Description of the Related Art

It is known in the art that strands are manufactured in such high-speed plants generally with a solidification thickness of between 18 and 450 mm and casting speeds of up to at most 15 m/min., for example, in plants for casting slabs, blooms and billets with quadratic or round profiles, wherein a reduction of the strand cross-section is preferably carried out during the solidification after the strand emerges from the mold.

This technology of casting and rolling of thin slabs or round billets is known from German patents 44 03 048, 44 03 049 and 41 39 242; in the case of thin slabs, this technology is used daily in production plants.

For example, a thin slab having a thickness of, for example, 65 mm is reduced to 40 mm in segment 0 which is arranged directly underneath the mold. This strand thickness reduction of 25 mm or 38.5% may be a disadvantage with respect to the quality of certain steels which are sensitive to internal ruptures. Thus, the internal deformation of the strand, due to the strand thickness reduction or also called casting and rolling, may trigger internal ruptures because the critical deformation of the material is exceeded at the inner strand shell liquid/solid, but also at the outer strand shell.

The above example is based on a circular arc segment 0 which has a length of 2 m and which does not introduce bending work or bending deformation into the strand shell. In this case, the deformation speed of the strand shell during casting and during solidification, which represents a measure for the strand deformation, is 1.25 mm/s at a casting speed of 6 m/min. When the casting speed is increased to, for example, 10 m/min., this value of the deformation speed increases to 2.08 mm/s and becomes very critical. Such internal deformations caused by casting and rolling are not only critical for deep drawing steel qualities which are relatively insensitive to internal deformations, but primarily for sensitive steels, such as microalloyed APX-80 qualities.

In addition, in vertical bending units in which usually bending of the strand occurs in the segment underneath the mold simultaneously with the deformation caused by casting and rolling, the bending deformation introduced into the strand is significantly increased, so that the danger of exceeding the critical deformation and, thus, the formation of cracks is even further increased.

SUMMARY OF THE INVENTION

Therefore, in view of the findings and relationships describes above, it is the primary object of the present invention to provide technical method measures and simple apparatus features for predetermining the deformation density of the strand cross-section reduction in such a way that the critical deformation of the strand is not exceeded while taking into consideration the casting speed and also the steel quality.

In accordance with the present invention, the continuous casting method for producing strands, wherein the cross-section of the strands is reduced during the solidification, includes casting into a mold, particularly an oscillating mold, and reducing the strand cross-section linearly over a minimum length of the strand guiding means immediately underneath the mold, i.e., casting and rolling, and subsequently carrying out a further strand cross-section reduction through the remaining strand guiding means, i.e., soft reduction, up to maximum reduction immediately in front of the final solidification or sump tip.

The continuous casting plant according to the present invention for carrying out the above-described method includes the following elements:

an oscillating mold;

a segment 0 which linearly reduces the strand in its cross-section at most by 40% over a length of at least 1 m;

a remaining strand guiding means which reduces the strand in its cross-section up to at most immediately following the sum tip, i.e., soft reduction; wherein the total reduction of the strand cross-section in segment 0 and in the remaining strand guiding means is configured to be up to 60%.

The features of the present invention are applicable to all sizes cast in a strand and also for all types of continuous casting plants.

The following unexpected solution according to the present invention for achieving the above-described objects will be explained in more detail in connection with a thin slab, wherein the invention is particularly discussed with respect to casting of thin slabs having a thickness of between 60 and 120 mm after solidification, i.e., the thickness of the slab in the edge areas is, for example, a minimum of 70 mm and a maximum of 160 mm at the mold exit. In accordance with the prior art, the reduction of the strand thickness, which usually takes place between the upper and the lower side of a strand guiding means, is today under test conditions at most 60%, i.e., a slab having a thickness of 50 mm is reduced to about 20 mm over a roll gap length of about 200 mm, and is under production conditions at most 38.5%, i.e., the strand is reduced from 65 to 40 mm over the length of the segment 0 which is about 2 m, wherein segment 0 is arranged underneath the mold. In both cases, the maximum casting speed is 6 m/min.

The invention will be described on the basis of an example of a thin slab having a thickness of 100 mm at the mold exit and a solidification thickness of 80 mm. The invention proposes a type of distribution and the realization of the slab thickness reduction during the solidification of the thin slab in the strand guiding stand for, for example, casting speeds of 6 and 10 m/min.

In tables 1 and 1.1, the essential process and apparatus data of the invention are compared to those of the prior art. Table 1 shows the data for casting speeds of 6 m/min and table 1.1 shows the data for casting speeds of 10 m/min.

In both tables, the total reduction of the thickness of the strand of 20 mm during the solidification is varied in its distribution between the segment 0 and the remaining strand guiding means, i.e., the segments 1 through at most 13. In the tables, the prior art is illustrated by a total reduction of the strand thickness of 20 mm carried out solely in segment 0 (compare items 19 through 22 in column 1). This clearly shows that the reduction speed of the strand is increased in the segment 0 which has a length of 3 m from 0.67 to 1.11 mm/s, triggered by the strand thickness reduction or the casting and rolling process and, thus, functionally the strand shell deformation, wherein the casting speed increases from 6 m/min to 10 m/min.

Items 19–22 and 23–28, columns 2, 3 and 4 and items 29–34 represent the solution according to the present invention which results in a significant lowering of the deformation density of the strand shell by a redistribution of the total thickness reduction of 20 mm between the segment 0 and the segments 1-n, also called soft reduction. This redistribution will be explained in detail with the aid of the following examples:

15 mm in segment 0 and 5 mm in the segments 1-n, items 19–28, column 2;

10 mm in segment 0 and 10 mm in segments 1-n, items 19–28, column 3;

5 mm in segment 0 and 15 mm in segments 1-n, items 19–28, column 4;

20 mm in segments 0-n, items 29–34.

In this manner, the reduction speed, and, thus the functional deformation density of the strand shell with a 20 mm total thickness reduction and 10 m/min casting speed can be reduced from:

1.11 mm/s, 20 mm in segment 0, according to the prior art, item 21, column 1, to 0.114 mm/s, 20 mm in segments 0–13, item 33.

However, as a result of displacing a portion of the thickness reduction from segment 0 into the segments 1–13 or 1–2, depending on the casting speed, the work to be introduced into the strand increases with increasing strand shell thickness. Therefore, the present invention takes into account that an optimum distribution of the total thickness reduction in the total strand guiding means between the segment 0 and the segment n, which reaches immediately behind the final solidification, also includes the strand shell thickness. This is achieved in an advantageous manner by a square root function over the solidification time either in the areas of the segments 1-n, soft reduction or in the areas of the segments 0-n, soft reduction.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
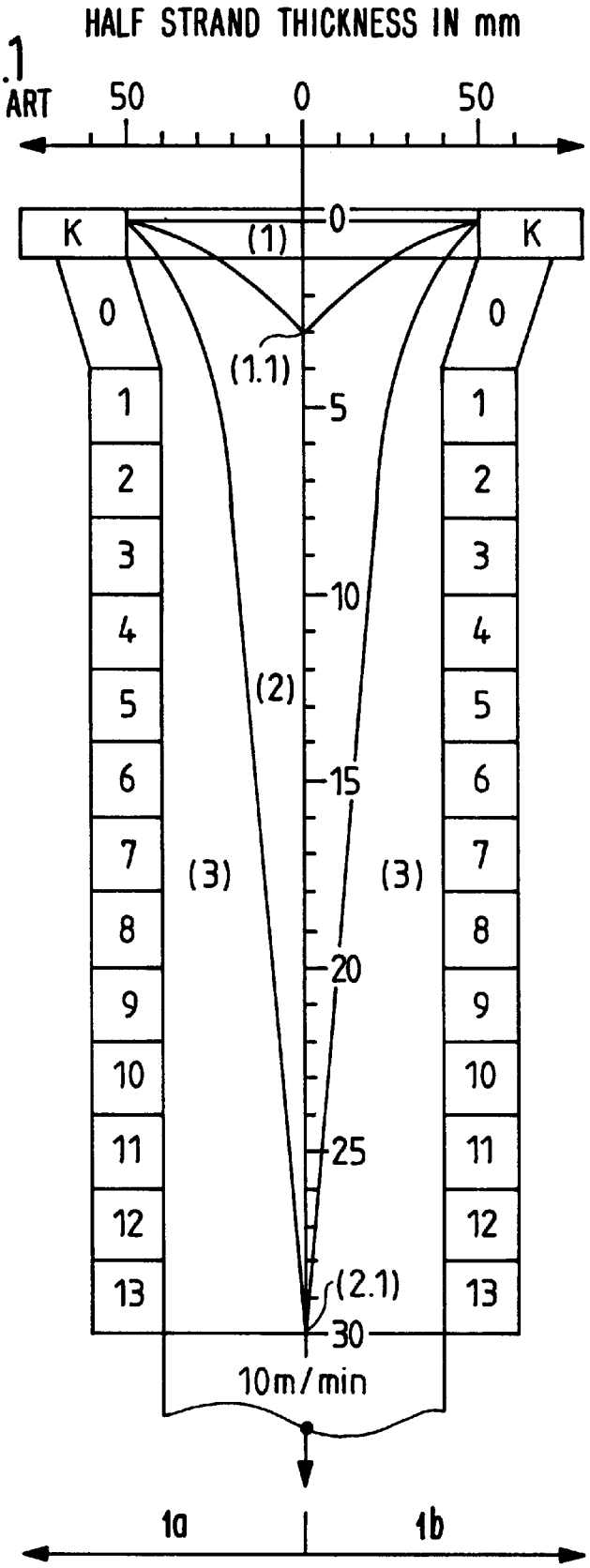
FIG.1 PRIOR ART
FIG. 1 is a diagram showing in illustration 1*a* a prior art method with a total reduction of the cast strand of 20 mm only in segment 0, and in illustration 1*b* the method according to the invention with a reduction of 10 mm in segment 0 and a soft reduction in segments 1–13.

FIG. 1 of the drawing schematically shows in partial illustrations 1*a* and 1*b* the situation of a strand having a thickness in the mold of 100 mm and a solidification thickness of 80 mm, with a casting speed of 10 m/min. and a total strand thickness reduction of 20 mm only in segment 0, i.e., casting and rolling in illustration 1*a* of FIG. 1, or 10 mm in segment 0, casting and rolling, and 10 mm in segments 1–13, i.e., soft reduction in illustration 1*b* of FIG. 1. Moreover, the diagram shows the strand in the machine with its steel phases, such as:

the overheating phase (1), the pure molten steel phase or also called penetration zone with its lowest liquidus point 1.1;

the two-phase area melt/crystal (2) with its lowest solidus point, the sump tip 2.1 after 30 m of strand guidance composed of a mold having a length of about 1.2 m, a segment 0 having a length of 3 m and the segments 1–13 having a total length of 26 m; and solid phase or strand shell (3).

The pure molten steel phase or also penetration zone is located in the area of segment 0 in which is carried out a strand thickness reduction or the casting and rolling of 2×10 mm or 20 mm and no further reduction in the following segments 1–13, in accordance with the prior art as shown on side 1*a* of FIG. 1, or, in accordance with the present invention, shown on side 1*b,* a reduction of 2×5 mm or 10 mm, i.e., casting and rolling, and an additional 10 mm in the following segments 1–13, i.e., soft reduction. The reduction of the strand thickness in segment 0, which is constructed, for example, as a tong-segment with two clamping devices, for example, hydraulic cylinders 14, at the segment exit, it is carried out linearly over a length of 3 m; the reduction in the area of the segments 1–13 can take place partially in each segment, or also linearly over all segments as well as non-linearly, i.e., following the example of a square root. On side 1*b* of FIG. 1, the strand thickness reduction of 10 mm is linearly distributed in segments 1–13, i.e., soft reduction.

When comparing the present invention, i.e., side 1*b* of FIG. 1, with the prior art, i.e., side 1*a* of FIG. 1, the reduction speed in mm/s of the strand shell which represents a measure for the strand shell deformation can be significantly reduced, as illustrated by the following values:

prior art, side 1*a:* segment 0, reduction 20 mm, casting and rolling, reduction speed 1.11 mm/s;

segments 1–13, reduction 0 mm, no soft reduction, reduction speed 0.

Invention, side 1*b:* segment 0, reduction 10 mm, casting and rolling, reduction speed 0.56 mm/s;

segments 1–13, reduction 10 mm, soft reduction, reduction speed 0.064 mm/s.

The distribution of the strand thickness reductions can now be selected between the segment 0 and the following segments 1–13 in an optimum manner with respect to the possible strand deformation while avoiding internal cracks and surface cracks and with respect to the minimum work to be introduced for strand thickness reduction which increases with the thickness of the strand shell.

Figure 2:
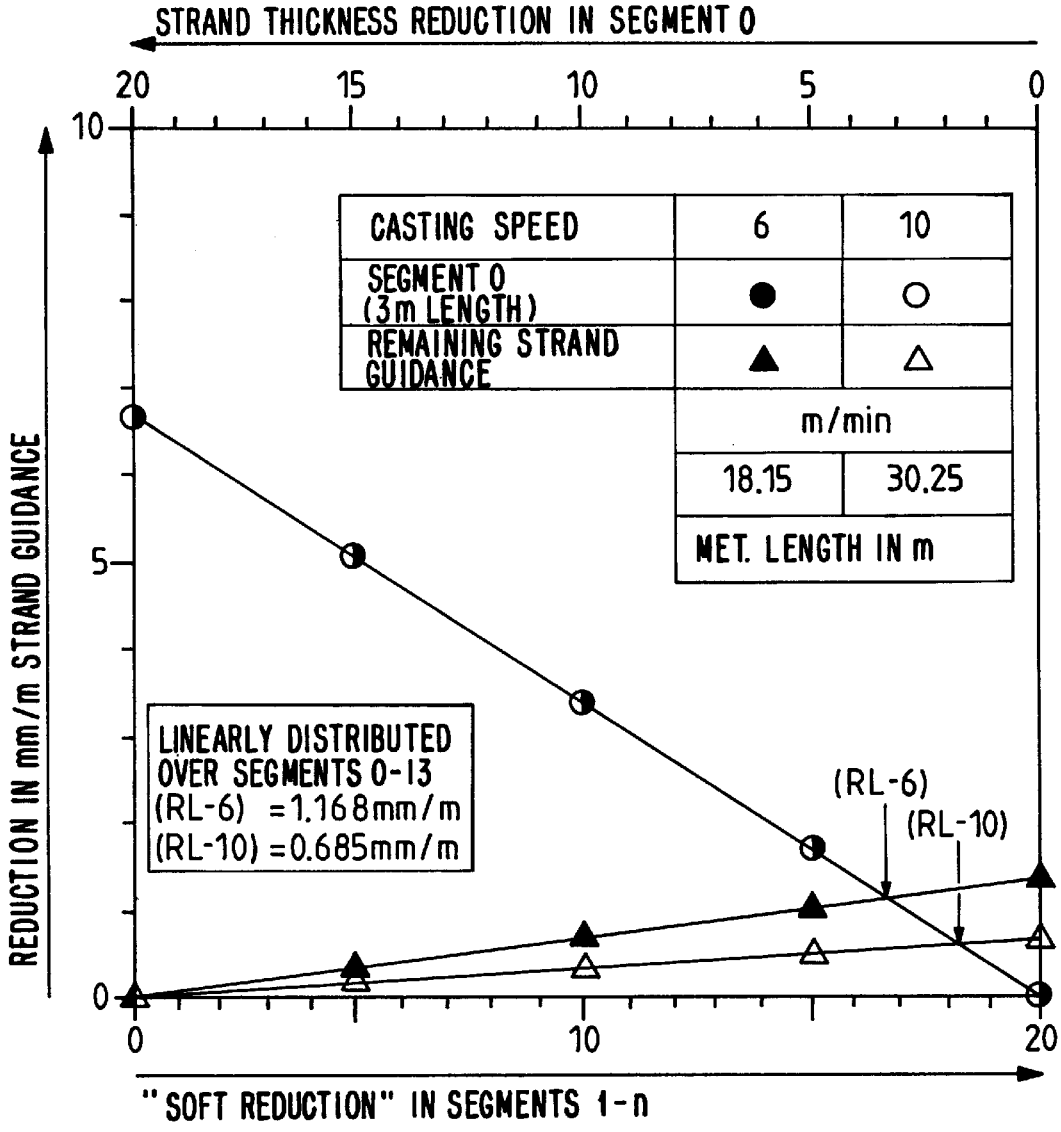
FIG. 2 is a diagram showing the strand thickness reduction in dependence on the soft reduction in the individual segments 1-n at casting speeds of 6 and 10 m/min.
Figure 3:
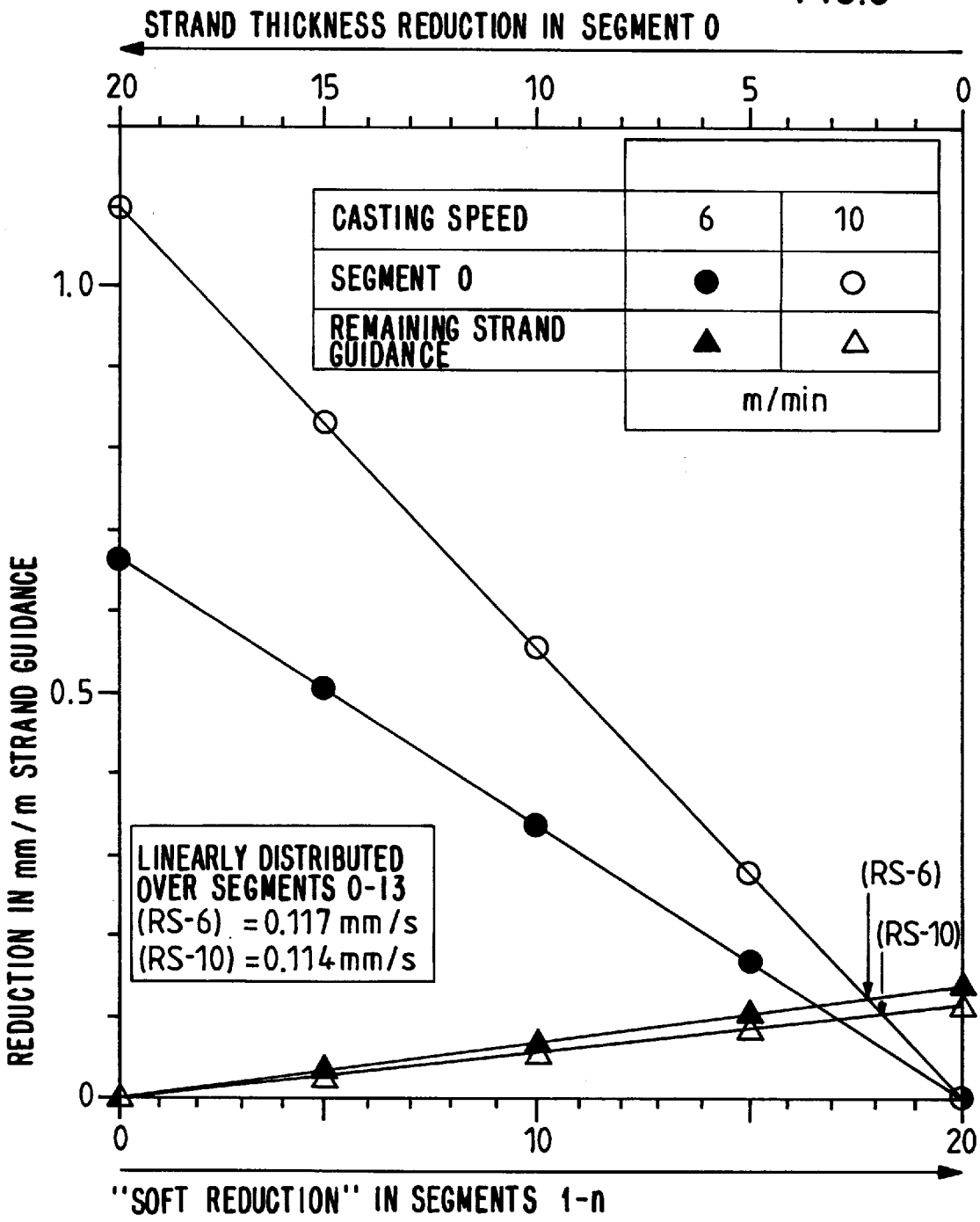
FIG. 3 is a diagram showing the reduction rate in dependence on the soft reduction in the individual segments 1-n at casting speeds of 6 and 10 m/min.

This distribution effect on the reduction speed and, thus, on the load acting on the strand shell, is indicated in tables 1 and 1.1 and is shown in FIGS. 2 and 3. FIG. 2 shows the reduction of the strand thickness in mm/m strand guidance for a total thickness reduction of 20 mm in dependence on different reductions in the segment 0 and the corresponding complimentary thickness reduction in the segments 1–13 for the continuous casting speeds of 6 and 10 m/min. In the case of a linear distribution of the total reduction of 20 mm over all segments 0 to 8 or 13, the following values are adjusted with respect to thickness reduction RL-6 and RL-10 and reduction speed RS-6 and RS-10 of:

1.168 mm/m strand guiding means RL-6 and 0.117 mm/s RS-6 at 6 m/min casting speed, or 0.685 mm/m strand guiding means RL-10 and 0.114 mm/s RS-10 at 10/min casting speed.

These values have the lowest deformation density, however, they require a maximum amount of work and result in a soft reduction process over the entire strand guiding means. The claimed invention takes into consideration the gap between the extreme of the total reduction of 20 mm in segment 0 and the uniform reduction distributed over the strand guiding means in segment 0 to shortly behind the final solidification of the strand.

Figure 4:
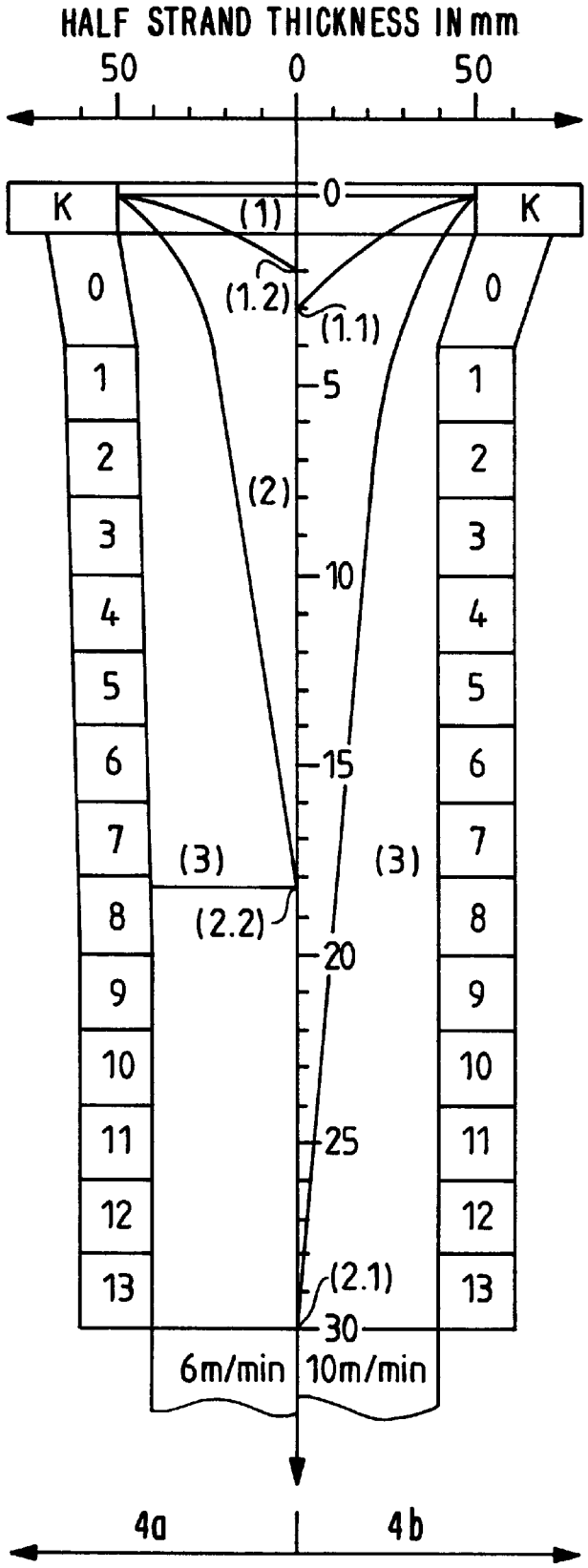
FIG. 4 is a diagram showing in illustration 4*a* a reduction of 10 mm in segment 0 and a soft reduction in segments 1–8 at a casting speed of 6 m/min; and in illustration 4*b* the method of the invention with a reduction of 10 mm in segment 0 and a soft reduction in segments 1–13.

As is the case in FIG. 1, FIG. 4 schematically illustrates the situation of a strand having a thickness in the mold of 100 mm and a solidification thickness of 80 mm for the casting speeds VG of 6 m/min, side 4*a* of FIG. 4, and 10 m/min, side 4*b*. In accordance with the present invention, in the case of VG 6 m/min, the strand thickness reduction of, for example, 10 mm is carried out in segment 0 and the remaining reduction of 10 mm is carried out in segments 1–8, corresponding to the shorter solidification distance. Thus, the lowest liquidus point 1.2 is already at about 1.8 m and the sump tip 2.2 is at about 18.12 m. Since the reduction of the strand thickness takes place at most over 18.12 m, and simultaneously is to include the final solidification, the segments 1–8 are utilized for the reduction of the thickness. As is the case in FIG. 1, side 1*b*, side 4*b* of FIG. 4 shows the situation of the strand in the case of a casting speed of VG 10 m/min.

The comparison of the casting situations according to the present invention shown on sides 4*a* and 4*b* of FIG. 4, results in the following values of the reduction speeds, and thus, loads acting on the strand shell:

6 m/min, side 4*a* of FIG. 4, example of the invention, segment 0, reduction 10 mm, reduction speed 0.33 mm/s, casting and rolling;

segments 1–8, reduction 10 mm, reduction speed 0.071 mm/s, soft reduction;

10 m/min, side 4*b* of FIG. 4, example of the invention, segment 0, reduction 10 mm, reduction speed 0.56 mm/s, casting and rolling;

segments 1–13, reduction 10 mm, reduction speed 0.064 mm/s, soft reduction.

This comparison demonstrates that the distribution of the thickness reduction is also a question of the casting speed and that, in accordance with the location of the sump tip, i.e., the casting speed, the thickness reduction and its distribution in the segments 1-n or 0-n, must be adapted to an optimum casting situation with respect to the casting safety and the strand quality.

Figure 5A:
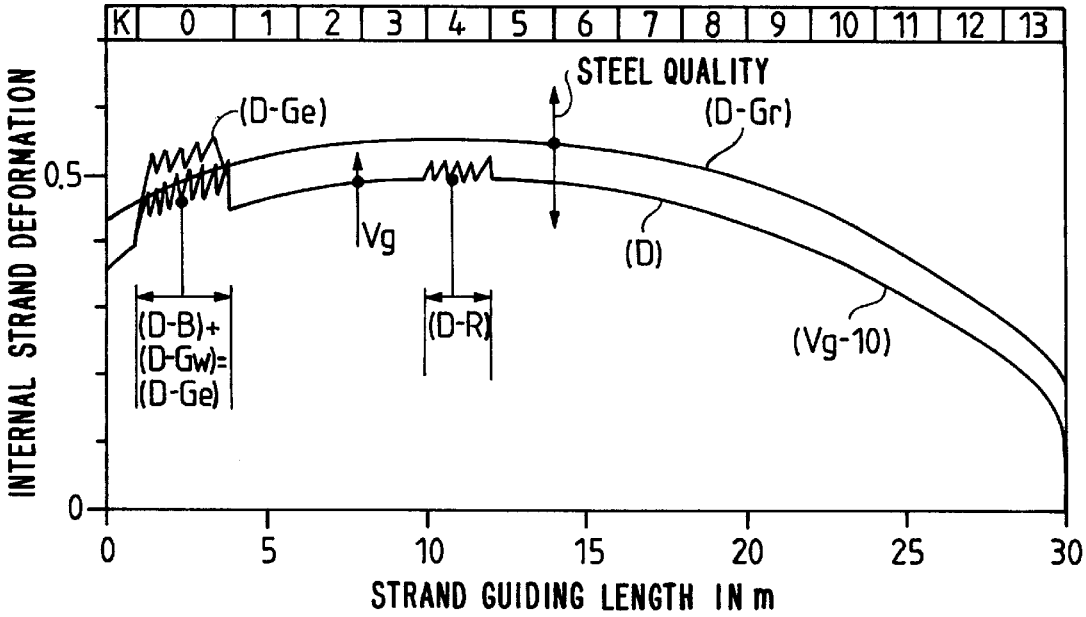
FIG.5A PRIOR ART
FIG. 5A shows the internal strand deformation at a reduction of the strand only in segment 0 in accordance with the prior art.
Figure 5B:
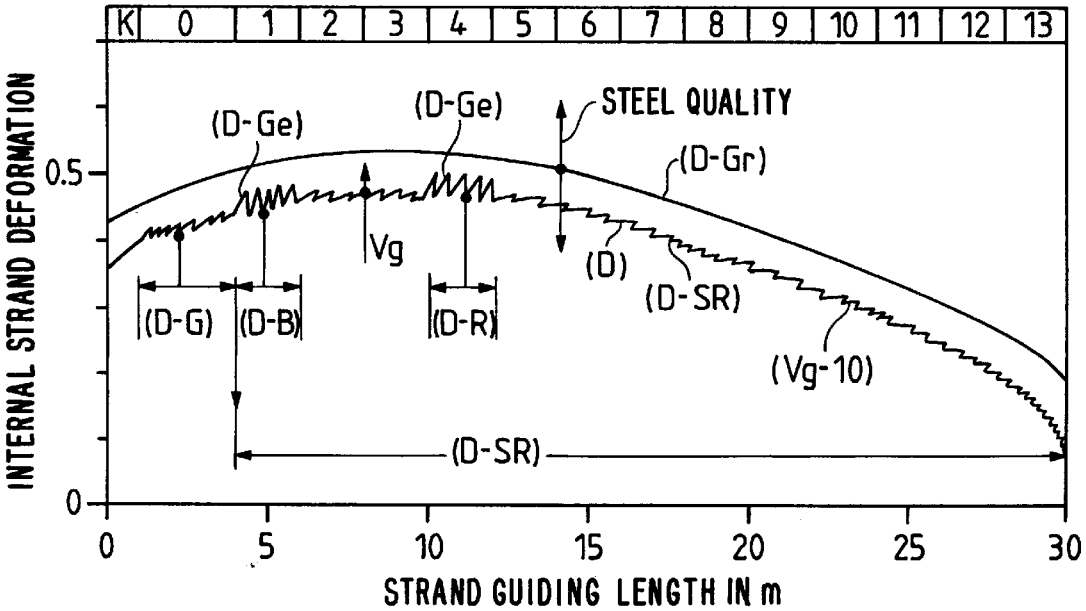
FIG. 5B shows the internal strand deformation at a reduction of the strand in segment 0 and in segments 1–13 according to the invention.

The drawing shows the effect of a distribution of the strand thickness reduction in segment 0 and in the segments 1–13 in accordance with the invention, illustrated in FIG. 5*b*, in the example of a vertical bending machine, as compared to the prior art shown in FIG. 5*a*, on the internal strand deformation caused by the bending deformation and the strand thickness reduction, in dependence on the strand guidance for the maximum casting speed of, for example 10 m/min.

FIG. 5*a* representing the prior art shows the internal strand deformation in dependence on the strand guiding means 4, for example, for a maximum casting speed Vg-10 of 10 m/min as compared to the limit deformation D-Gr. At the exit of the mold, the strand is subjected to a deformation caused by casting and rolling D-Gw in segment 0, as well as to a deformation caused by the bending process D-B. Both deformations are superimposed to the total deformation D-Ge which is greater than the limit deformation D-Gr and, thus, becomes critical. When the limit deformation is exceeded, this leads to internal cracks at the phase boundary solid/liquid, and, thus, to a diminished quality of the strand and to a lowering of the casting safety. The strand is subjected to another increase of the internal deformation D by the deformation D-R occurring during return bending in segment 4 from the inner circular arc into the horizontal which, however, cannot be critical because the number of return bending points is selected when "designing" the plant in such a way that the return bending process cannot trigger at maximum casting speed a critical internal deformation in the strand shell of the steel quality which is most sensitive to cracks.

Figure 6:
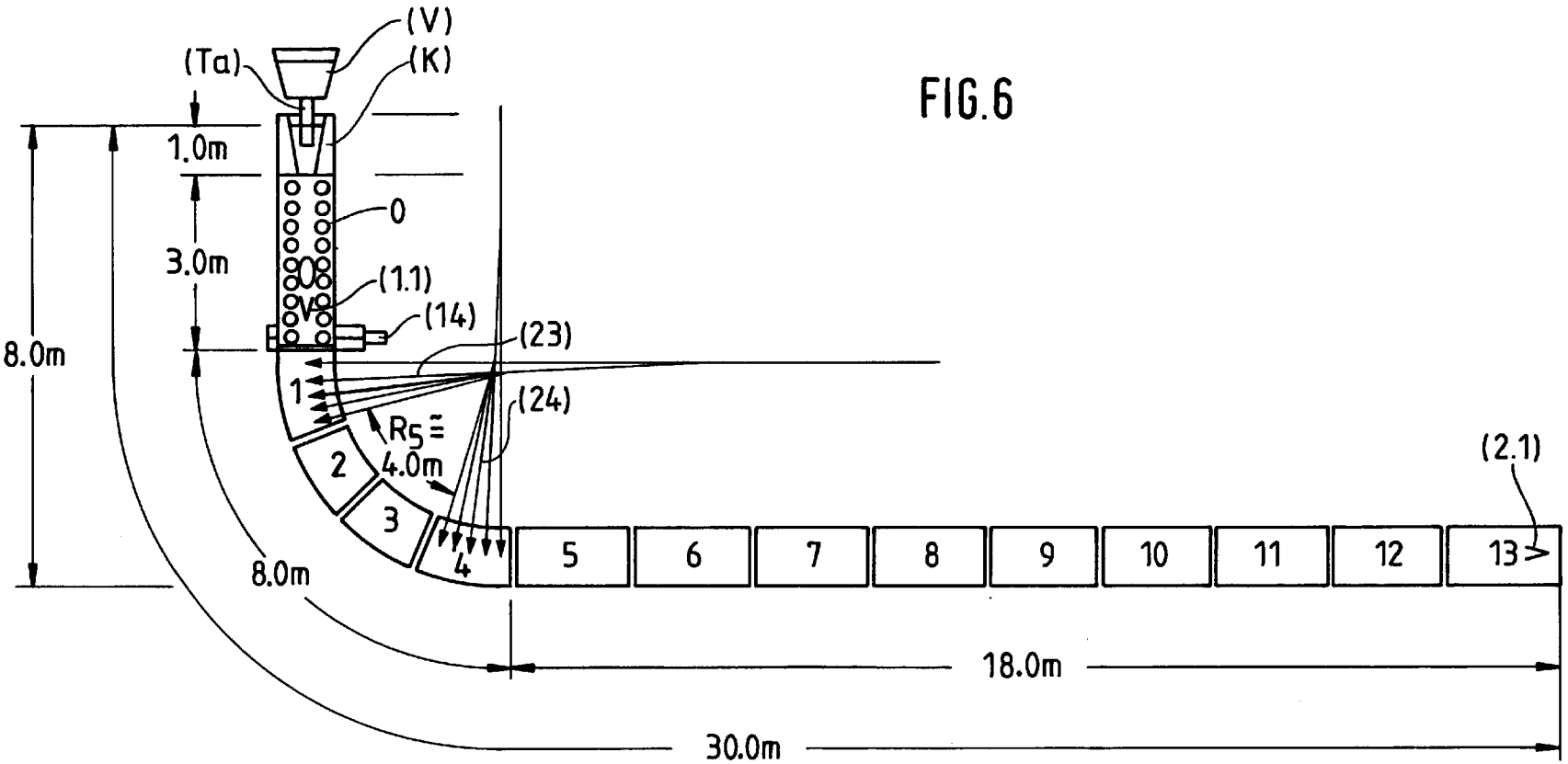
FIG. 6 is a schematic illustration of the continuous casting plant according to the present invention with a vertical bending unit with segment 0 and segments 1–13.

FIG. 5*b* shows the technical features of the method according to the present invention in connection with a vertical bending plant, as schematically illustrated in FIG. 6. The internal deformation D of the strand shell 3 does not become critical at any moment of solidification, i.e., from the mold exit to the end of the stand 13. In accordance with the invention, this is ensured by the distribution of the total strand thickness reduction of 20 mm to, for example, 10 mm in segment 0 D-Gw and 10 mm in the stands 1–13 D-sr. In addition, the bending process and the attendant deformation D-V has been transferred from segment 0 to segment 1 in order not to additionally increase the deformation density D-Gw in segment 0, which is caused by casting and rolling of, for example, 10 mm and, while lowered, is still relatively high. The deformation D-SR produced in segments 1–13 and caused by soft reduction of a total of, for example, 10 mm, is relatively small and does not result in a practical increase of the deformation D-R when return bending the strand in segment 4, i.e., D-Ge is approximately greater than/equal to D-R.

FIG. 6 shows a vertical bending unit in which the present invention can be used for casting slabs having a thickness of 100 mm at the mold exit with a solidification thickness of 80 mm and a maximum VG 10 m/min. This plant has the technical method features described in connection with FIGS. 1–5. In addition to a distributor V and a submerged pouring pipe Ta, the continuous casting plant includes:

a vertical mold K having a length of about 1.2 m, which is preferably constructed concavely in horizontal direction;

a segment 0 having a length of 3 m, which is equipped for casting and rolling or also for strand thickness reduction preferably as a tong-type segment and with two hydraulic cylinders 14 at its exit;

segment 1 with 5 bending points 23;

segments 2 and 3 with the inner circular arc having a radius of about 4 m;

segment 4 for return bending the strand from the inner circular arc through five return bending points 24 into the horizontal; and segments 5–13 in the horizontal portion of the machine.

This machine configuration with a maximum casting speed of 10 m/min and a maximum capacity of about 3 million tons per year constitutes an extremely advantageous solution for use of the invention in which a minimum deformation density of the strand occurs during its solidification.

Figure 7:
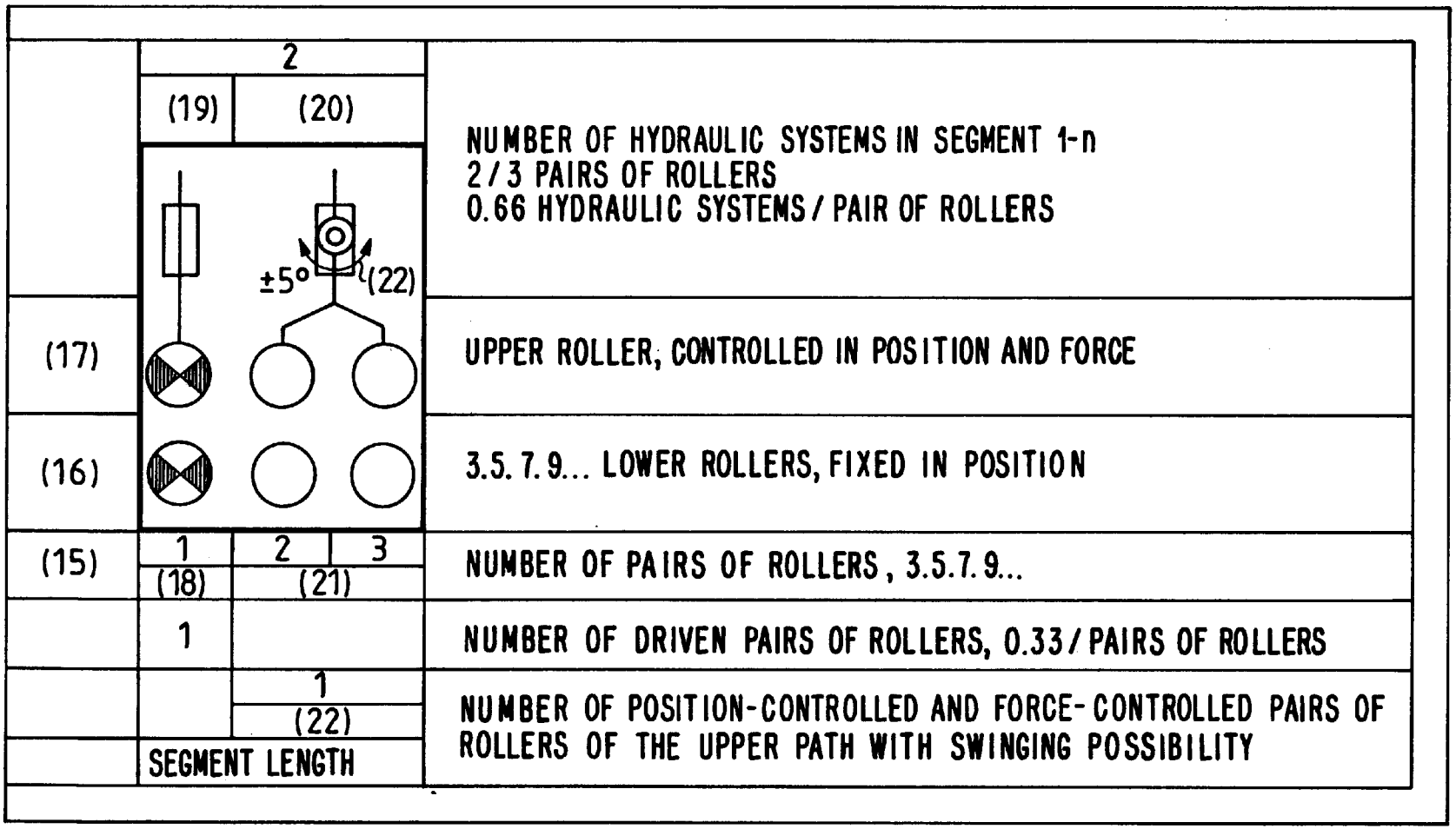
FIG. 7 is a schematic illustration of the structure of the segments of the strand guiding unit for carrying out the invention.

In order to be able to advantageously realize the type of strand thickness reduction according to the present invention in the above-described segments 1–13, the segments should be constructed in principle as illustrated in FIG. 7. A segment should preferable be constructed of an odd number of 3, 5, 7 or 9 pairs of rollers 15, wherein each pair has a lower roller 16 and an upper roller 17. Each segment, in turn, is alternatingly composed of a driven pair of rollers 18, controlled with respect to position and force by a hydraulic system 19, and two non-driven pairs of rollers 21 which are connected to a hydraulic system 20 in the area of the upper rollers 17 and are provided with a machine element 22 which makes it possible to allow the pair of rollers of the upper path in casting direction to swing about an angle of, for example +/−5 degrees in order to be able to guide the strand and ensure its shape in any casting situation with a given strand thickness reduction.

This configuration of the segments 1–13 results in an optimum strand guidance in any type of distribution of the strand thickness reduction, any casting situation, any type of steel quality, with respect to its sensitivity to internal cracks, i.e., the level of the critical deformation limit and with respect to the use of a minimum of hydraulic systems for each pair of rollers. Thus, 0.66 hydraulic systems are used for each pair of rollers. Also, the use of driven pairs of rollers of 0.33 units per pair of rollers represents a mechanical minimum with a maximum effect with respect to process technology and quality of the strand to be cast and its outer surface quality and its internal quality, i.e., for example, a minimum structural requirement and a minimum cumulation of tensile stresses in the strand shell between the driven pairs of rollers.

The present invention has been described in connection with a thin slab plant; however, the present invention can also be utilized with respect to the method and the apparatus in other continuous casting plants, such as:

slab plants;

bloom plants; and billets plants for square and round billets.

While specific embodiments of the invention have been shown and described in detail to illustrate the inventive principles, it will be understood that the invention may be embodied otherwise without departing from such principles.

TABLE 1

| | | | Casting Speed 6 m/min | | | | |
|---|---|---|---|---|---|---|---|
| | | | 1 | 2 | 3 | 4 | 5 |
| 1 | Strand thickness | mm | 100 | | | | |
| 2 | Solidification Thickness | mm | 80 | | | | |
| 3 | Metallurgical length of the mold | m | 1 | | | | |
| 4 | Length of the segment 0 | m | 3 | | | | |
| 5 | Length of segments 1–13 | m | 26 | | | | |
| 6 | Length of the total strand guidance | m | 30 | | | | |
| 7 | Solidification time | min | 3, 02 | | | | |
| 8 | Solidification time | B | 181, 2 | | | | |
| 9 | Casting speed | m/min | 6, 0 | | | | |
| 10 | Metallurgical length of the strand | m | 18, 12 | | | | |
| 11 | Solidification time, entering segment 0 | min | 0, 167 | | | | |
| 12 | Solidification time, entering segment 0 | s | 10, 0 | | | | |
| 13 | Strand shell thickness, entering segment 0 | mm | 9, 4 | | | | |
| 14 | Travel time of strand in segment 0 | min | 0, 5 | | | | |
| 15 | Travel time of strand in segment 0 | s | 30, 0 | | | | |
| 16 | Solidification time, leaving segment 0 | min | 0, 667 | | | | |
| 17 | Solidification time, leaving segment 0 | s | 40, 02 | | | | |
| 18 | Strand shell thickness, leaving segment 0 | 18, 78 | | | | | |
| 19 | Thickness reduction in segment 0 | mm | 20 | 15 | 10 | 5 | 0 |
| 20 | Thickness reduction in segment 0 | % | 20 | 15 | 10 | 5 | 0 |
| 21 | Reduction speed | mm/s | 0, 67 | 0, 5 | 0, 33 | 0, 17 | 0 |
| 22 | Reduction/meters of strand guidance | mm/m | 6, 67 | 5, 0 | 3, 33 | 1, 67 | 0 |
| 23 | Soft reduction in segment 1-n(8) | mm | 0 | 5 | 10 | 15 | 20 |
| 24 | Time for remaining solidification | min | | | 2, 353 | | |

TABLE 1-continued

| | | | Casting Speed 6 m/min | | | | |
|---|---|---|---|---|---|---|---|
| | | | 1 | 2 | 3 | 4 | 5 |
| 25 | Time for remaining solidification | s | | | 141, 18 | | |
| 26 | Soft reduction speed | mm/s | 0 | 0, 035 | 0, 071 | 0, 106 | 0, 14 |
| 27 | Metallurgical length of the residual solidification | m | | | 14, 12 | | |
| 28 | Soft reduction/meters residual solidification | mm/m | 0 | 0, 35 | 0, 71 | 1, 062 | 1, 42 |
| 29 | Soft reduction, segment 0-n(8) | mm | | | 20 | | |
| 30 | Time of solidification in segments 0-n | min | | | 2, 853 | | |
| 31 | Time of solidification in segments 0-n | s | | | 171, 18 | | |
| 32 | Metallurgical length, segments 0-n | m | | | 17, 12 | | |
| 33 | Soft reduction - speed, segments 0-n | mm/s | | | 0, 117 | | |
| 34 | Soft reduction/meters solidification, segments 0-n | mm/m | | | 1, 168 | | |

TABLE 1.1

| | | | Casting Speed 10 m/min | | | | |
|---|---|---|---|---|---|---|---|
| | | | 1 | 2 | 3 | 4 | 5 |
| 1 | Strand thickness | mm | 100 | | | | |
| 2 | Solidification Thickness | mm | 80 | | | | |
| 3 | Metallurgical length of the mold | m | 1 | | | | |
| 4 | Length of the segment 0 | m | 3 | | | | |
| 5 | Length of segments 1-13 | 20 | | | | | |
| 6 | Length of the total strand guidance | m | 30 | | | | |
| 7 | Solidification time | min | 3, 02 | | | | |
| 8 | Solidification time | s | 181, 2 | | | | |
| 9 | Casting speed | m/min | 10, 0 | | | | |
| 10 | Metallurgical length of the strand | m | 30, 20 | | | | |
| 11 | Solidification time, entering segment 0 | min | 0, 10 | | | | |
| 12 | Solidification time, entering segment 0 | s | 6, 0 | | | | |
| 13 | Strand shell thickness, entering segment 0 | mm | 7, 3 | | | | |
| 14 | Travel time of strand in segment 0 | min | 0, 3 | | | | |
| 15 | Travel time of strand in segment 0 | s | 18, 0 | | | | |
| 16 | Solidification time, leaving segment 0 | min | 0, 4 | | | | |
| 17 | Solidification time, leaving segment 0 | s | 24, 0 | | | | |
| 18 | Strand shell thickness, leaving segment 0 | mm | 14, 55 | | | | |
| 19 | Thickness reduction in segment 0 | mm | 20 | 15 | 10 | 5 | 0 |
| 20 | Thickness reduction in segment 0 | % | 20 | 15 | 10 | 5 | 0 |
| 21 | Reduction speed | mm/s | 1, 11 | 0, 83 | 0, 56 | 0, 28 | 0 |
| 22 | Reduction/meters of strand guidance | mm/m | 6, 67 | 5, 0 | 3, 33 | 1, 67 | 0 |
| 23 | Soft reduction in segment 1-n(13) | mm | 0 | 5 | 10 | 15 | 20 |
| 24 | Time for remaining solidification | min | | | 2, 62 | | |
| 25 | Time for remaining solidification | s | | | 157, 2 | | |
| 26 | Soft reduction speed | mm/s | 0 | 0, 032 | 0, 064 | 0, 095 | 0, 127 |
| 27 | Metallurgical length of the residual solidification | m | | | 26, 2 | | |

TABLE 1.1-continued

| | | | Casting Speed 10 m/min | | | | |
|---|---|---|---|---|---|---|---|
| | | | 1 | 2 | 3 | 4 | 5 |
| 28 | Soft reduction/meters residual solidification | mm/m | 0 | 0, 19 | 0, 38 | 0, 57 | 0, 76 |
| 29 | Soft reduction, segment 0-n (13) | mm | | | 20, 0 | | |
| 30 | Time of solidification in segments 0-n | min | | | 2, 92 | | |
| 31 | Time of solidification in segments 0-n | s | | | 175, 2 | | |
| 32 | Metallurgical length, segments 0-n | m | | | 29, 2 | | |
| 33 | Soft reduction - speed, segments 0-n | mm/s | | | 0, 114 | | |
| 34 | Soft reduction/meters solidification, segments 0-n | mm/m | | | 0, 685 | | |

I claim:

1. A method of continuous casting for producing rectangular strands, wherein a cross-section of the strands is reduced during solidification, the method comprising pouring liquid metal in a mold for casting a strand and reducing the strand cross-section by a reduction in the thickness direction linearly over a minimum length of a strand guiding means immediately below the mold for carrying out casting and rolling, carrying out a subsequent further non-linear strand cross-section reduction over a remaining length of the strand guiding means for effecting soft reduction up to a maximum of immediately in front of an end solidification or sump tip, further comprising reducing the thickness of the strand by at most 60% of a strand thickness at a mold exit.

2. The method according to claim 1, comprising oscillating the mold.

3. The method according to claim 1, comprising reducing a thickness of thin slabs with a solidification thickness of 120–50 mm.

4. The method according to claim 1, comprising reducing a strand thickness with a rate of less than 1.25 mm/s by dividing a total thickness reduction into the rolling and casting reduction immediately underneath the mold and the soft reduction in the remaining strand guiding means at a maximum casting speed.

5. The method according to claim 1, comprising casting with a maximum casting speed of 12 m/min.

6. The method according to claim 1, comprising reducing a strand thickness during soft reduction over a solidification length.

7. The method according to claim 1, comprising reducing a strand thickness during soft reduction in accordance with a square root function over a solidification period.

8. The method according to claim 1, wherein a total thickness reduction is carried out and steadily from a mold exit to at most directly following the sump tip.

9. The method according to claim 1, comprising carrying out bending of the strand from the vertical into an inner circular arc of a vertical bending continuous casting plant in the range of soft reduction.

10. The method according to claim 1, comprising carrying out casting and rolling exclusively in a vertical strand guiding means without the lowest liquidus point leaving the strand guiding means at a maximum casting speed.

* * * * *